United States Patent [19]

Tovenrath et al.

[11] Patent Number: 4,525,906

[45] Date of Patent: Jul. 2, 1985

[54] DEVICE FOR DRAWING WARP THREADS INTO READIED HEDDLES AND DROP WIRES

[75] Inventors: Claus Tovenrath; Florian Windischbauer, both of Lindau, Fed. Rep. of Germany

[73] Assignee: Lindauer Dornier Gesellschaft mbH, Lindau, Fed. Rep. of Germany

[21] Appl. No.: 428,769

[22] Filed: Sep. 30, 1982

[30] Foreign Application Priority Data

Mar. 25, 1982 [DE] Fed. Rep. of Germany ..... 3210921

[51] Int. Cl.[3] ..... D03J 1/14

[52] U.S. Cl. ..... 28/205

[58] Field of Search ..... 28/203, 204, 205, 201, 28/206

[56] References Cited

U.S. PATENT DOCUMENTS

| | | | |
|---|---|---|---|
| 500,964 | 7/1893 | Sherman | 28/203 |
| 1,482,648 | 2/1924 | Hathaway et al. | 28/204 |
| 1,928,704 | 10/1933 | Samitz | 28/203 |
| 4,014,083 | 3/1977 | Heinz | 28/205 |

FOREIGN PATENT DOCUMENTS

| | | | |
|---|---|---|---|
| 2444566 | 1/1978 | Fed. Rep. of Germany . | |
| 2847520 | 8/1981 | Fed. Rep. of Germany . | |
| 158259 | 4/1964 | U.S.S.R. | 28/203 |

*Primary Examiner*—Robert R. Mackey

*Attorney, Agent, or Firm*—W. G. Fasse; D. H. Kane, Jr.

[57] ABSTRACT

Several draw-in needles are arranged in parallel in a warp thread draw-in device. The draw-in needles can be coupled selectively individually or in combination to an advanceable carriage. When the carriage is advanced, only the selected and coupled draw-in needles are carried along whereby the draw-in procedure is carried out simultaneously. The selection of the draw-in needles as a function of the desired patterning can be implemented automatically by a program control.

9 Claims, 9 Drawing Figures

DEVICE FOR DRAWING WARP THREADS INTO READIED HEDDLES AND DROP WIRES

FIELD OF THE INVENTION

The invention relates to a device for drawing warp threads into readied heddles and drop wires with several alternatingly reciprocating draw-in needles arrayed in parallel and moving through the eyes of heddles and drop wires in the direction of the warp threads presented in a predetermined position in the form of a curtain of threads.

DESCRIPTION OF THE PRIOR ART

In order to prepare the weaving process, the warp threads wound on a warp beam must be drawn individually through the eyes of each heddle and through the apertures of drop wires by means of a draw-in needle. Presently this procedure takes place, as a rule, outside the weaving machine proper. However, before a warp thread can be seized by the draw-in needle, each warp thread must be separated singly from the curtain of threads wherein the warp threads are arrayed tightly against each other, and be readied by the draw-in needle in a specific position for purposes of transfer.

An automatically operating draw-in apparatus to draw the warp threads into the heddles and drop wires is known, wherein the draw-in needles are made to pass through the eyes of heddles and drop wires and engage the warp thread to be drawn-in. Then the draw-in needles are retracted in the opposite direction again through the heddles and drop wires, whereby the thread seized by the draw-in needle is pulled through the heddle and drop wire. The draw-in needles are provided at their tips with means for gripping the presented warp thread, for instance with hook-shaped structures. German Pat. No. 2,444,566 describes, for instance, a draw-in needle equipped with a thread clamp. The draw-in needle itself is a hollow section wherein a slider is mounted in a displaceable manner for controlling the thread clamp. The slider is actuated from the rear end of the needle. When such needles are used, the warp threads can be pulled through the heddles without thereby forming loop threads which would permit the threads to pass twice through the eyes during their draw-in motion. Accordingly, textile yarn material of all structure types can be drawn into the weaving parts without thread damage.

Ordinarily, the warp threads are drawn-in individually and consecutively using one and the same needle. Accordingly, the speed of operation is low. The nature and manner of the advance and retraction of the draw-in needle is not described in further detail in the above-cited German Patent, No. 2,444,566.

German Pat. No. 2,847,520 describes an apparatus for presenting warp threads for automatically drawing the warp threads into heddles and drop wires. This known apparatus provides that several warp threads are kept ready at precise mutual spacings for the transfer and also that simultaneously several draw-in needles can be inserted and fed with warp threads. As a result, the operational speed of this apparatus is higher, however in this reference again the needle drive is not described in further detail.

A problem arises with respect to draw-in machines with several parallel draw-in needles due to the requirement that warp threads are to be drawn-in for the most diverse patterns. The above-cited known apparatus with simultaneous multiple drawing-in however is unsuited for such purpose.

OBJECT OF THE INVENTION

It is an object of the present invention to so improve a draw-in apparatus with several parallel draw-in needles that the warp threads to be drawn-in will be seized entirely according to patterning requirements and can be automatically drawn into the heddles of the associated frames or into the drop wires. Another partial object is to arrange the overall device as compactly as possible.

SUMMARY OF THE INVENTION

This problem is solved by the invention by providing a common drive in the form of a displaceable carriage for all of the parallel draw-in needles, and in that the draw-in needles can be coupled individually as needed with the carriage. The carriage can be displaced on a guide means and is advantageously provided with a toothed component, for instance gear racks, engaging a drive pinion with alternating directions of rotation. The draw-in needles are guided by the carriage outside the heddle frame areas in a fixed needle bed. In a further embodiment of the invention, the needle bed for the draw-in needles is of a straight construction across the range of advance of the carriage and then curves off. The advance path of the carriage extends in parallel to the curtain of threads of the presented warp threads and to the readied heddle frames. Outside the feed advance path of the carriage the guidance means for the needle bed curves by 90° toward the heddle frames and toward the presented warp threads. In this manner the need for space is much reduced. The construction of the needles proper and their devices for seizing the warp threads can be as desired, it being important only that on one hand they be flexible enough for the deflection in the curved part of the needle bed and that on the other hand they be sufficiently rigid to be freely advanced through the heddles and drop wires in the region of the heddle frames.

Narrow limits need not be met by the number of advanceable draw-in needles which can be coupled with the carriage, however practice has shown that a maximum of six draw-in needles will be sufficient which number corresponds to the number of six rows of drop wires which are usually available. Experience shows that in almost all cases at least four needles can be simultaneously operational. The control of the needle coupling is also not subject to any restriction. In principle, any draw-in needle or needle combination can be selected and can be coupled to the carriage for the draw-in procedure; advantageously, however, the selection of the draw-in needles always takes place in ascending sequence, that is, illustratively needles 1 and 2 or needles 1, 2, and 3 or needles 1 to 6. A programmed electronic pattern input for the needle coupling can be provided. The needle coupling and the carriage drive are mutually adjusted and furthermore, just as for the separation and the readying of the warp threads of the curtain of threads and the individualization and positioning of the heddles, etc., can be controlled and monitored by microprocessors. In this manner the warp threads can be drawn-in in a completely automatic manner in a short time and at a high operational speed for any pattern variation.

BRIEF DESCRIPTION OF THE DRAWINGS

The invention will be further explained with reference to the accompanying drawings, in which.

DETAILED DESCRIPTION OF PREFERRED EXAMPLE EMBODIMENTS AND OF THE BEST MODE OF THE INVENTION

Figure 1:
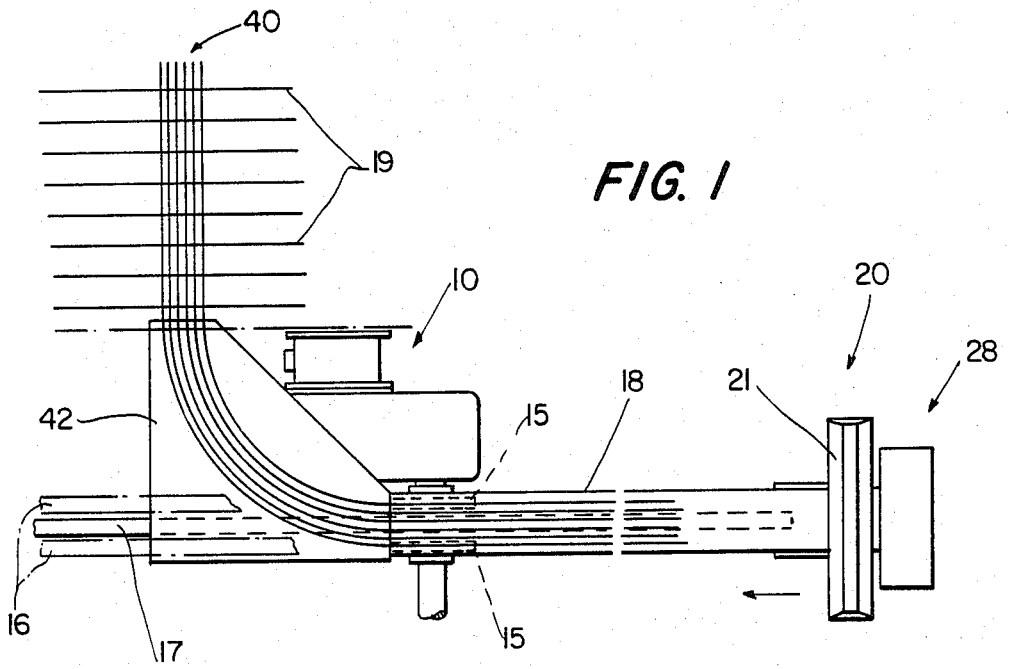
FIG. 1 is a schematic top view of a draw-in device.

The construction of a compact draw-in device will be first described in general form with reference to FIG. 1. A carriage 20 is rectilinearly displaceable back and forth on a carrier rail 17 in the direction indicated by the arrow. A drive unit 10 is provided for the displacement and will be described in further detail below with reference to FIGS. 2*a* and 2*b*. A cross-part is solidly joined to the spatially fixed carrier rail 17 and contains rectilinear guide grooves corresponding to the displacement path of the carriage 20 for a number of draw-in needles 40 and is denoted as the needle bed 18. The needle bed 18 together with its guide grooves merges into a curved needle guide section 42 wherein the path of the draw-in needles is deflected by 90°. The needles 40 presently point in the direction of the heddle frames 19 indicated merely schematically by plain lines, i.e. to the warp threads behind the heddle frames presented there but omitted from the drawing. When in their rest positions, the needles 40 are seated in the guide grooves of the fixed needle bed 18 or the curved needle guide section 42. To draw in the warp threads, the carriage 20 is advanced, carrying along the needles 40, whereby they leave the curved needle guide section 42, pass through the heddle frames 19, grip the associated warp threads and during their retraction draw the warp threads into (not shown) eyes of the individualized and positioned heddles. FIG. 1 furthermore indicates on the right-hand side from the carriage 20 a control means 28 which is spatially fixed in place and serves to control the coupling of individual draw-in needles 40 with the reciprocating carriage 20.

Figure 2A:
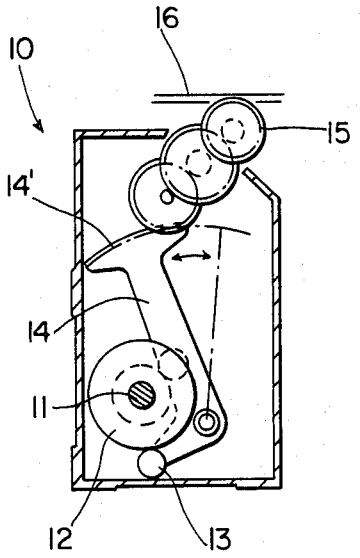
FIGS. 2*a* and 2*b* are two sections of the drive means.
Figure 2B:
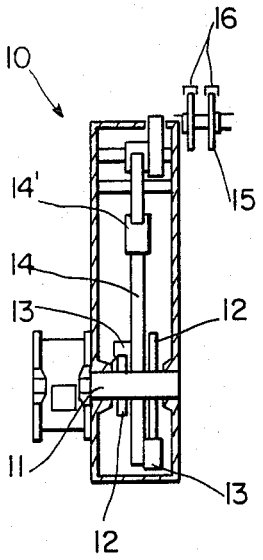

FIGS. 2*a* and 2*b* show, in a simplified manner, a known drive unit 10 for driving the carriage. In the example selected here, one or two cams 12 are seated on a constantly rotating shaft 11 and transmit a motion in known manner through follower rollers 13 to a rocking lever 14 whereby the rotation is converted into a rocking motion. The rocking motion of the rocking lever 14 is indicated in FIG. 2*a* by a double arrow and by dash-dot lines. The rocking lever 14 is provided at its end with a gear sector 14′ meshing with a gear and, possibly through the intermediary of further gears imparting an alternating rotating motion to a drive pinion 15. The pinion 15 meshes with a toothed component mounted to the carriage 20, in this instance a gear rack. As shown by FIG. 2*b* and also by FIG. 1, a pair of drive pinions 15 is provided for a corresponding pair of gear racks 16. The two gear racks 16 are indicated in the advanced position by dash-dot lines in FIG. 1. Other embodiments of the drive units and toothed segments also can be used without problems.

Figure 3:
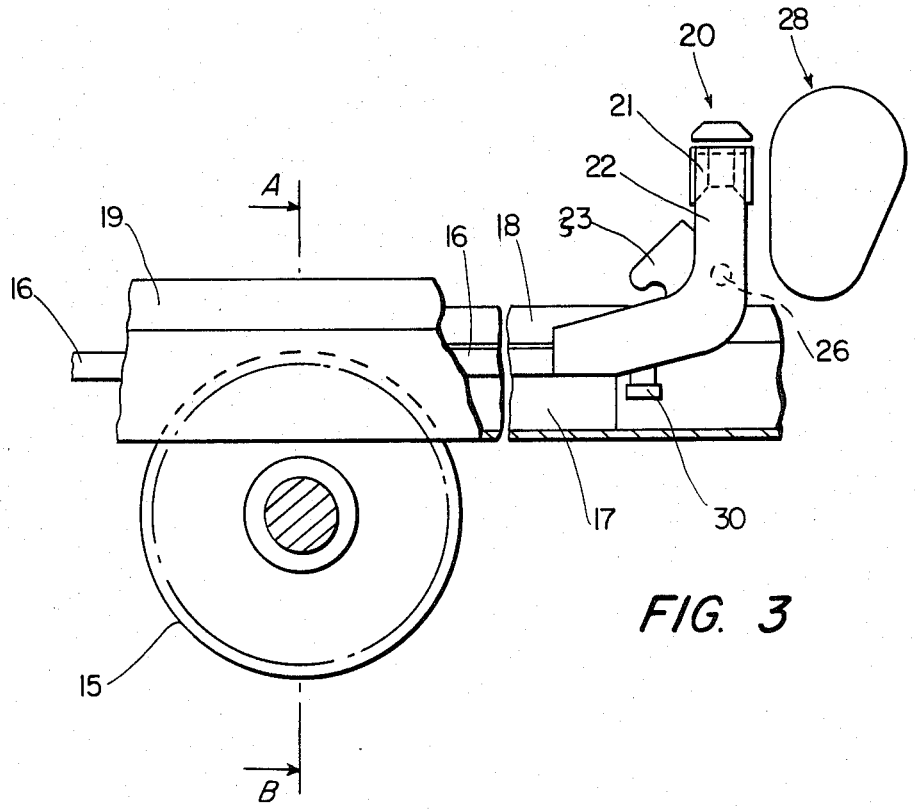
FIG. 3 is a side view of the needle coupling.
Figure 4:
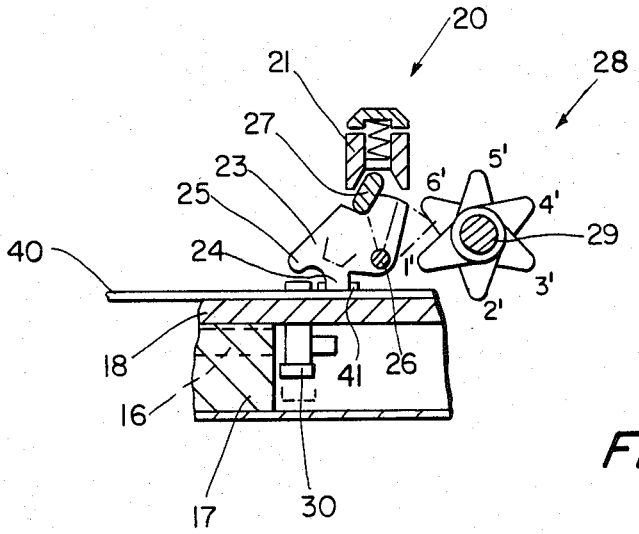
FIG. 4 is a longitudinal section through the right-hand part of FIG. 3.
Figure 5:
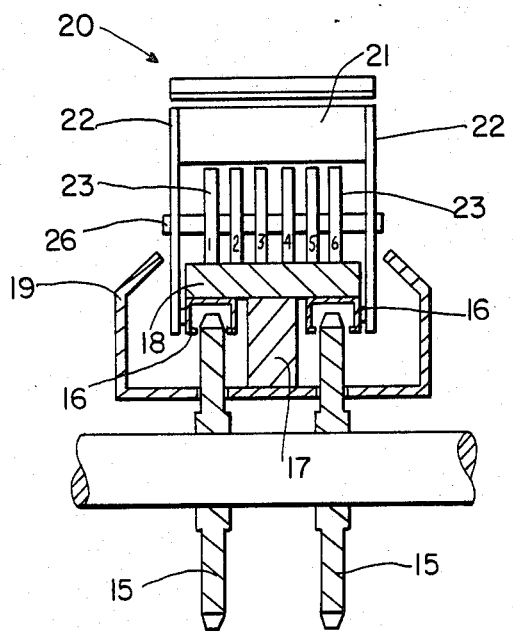
FIG. 5 is a cross-section through FIG. 3 along line A–B.

FIGS. 3, 4, and 5 show details of the carriage 20. Again, the spatially fixed carrier rail 17 with its cross-component acting as the needle bed 18 are shown. As mentioned above, the needle bed 18 contains a row of guide grooves for the draw-in needles 40.

These draw-in needles 40 are indicated in FIG. 5 merely by their sequence from 1 to 6. FIG. 4 also shows a draw-in needle 40 laid in the upper part of the needle bed 18. The beam 17 and the needle bed 18 can be enclosed by a casing 19 provided with a wide, slotted aperture at the top for the path of motion of the carriage 20. The guide grooves 18 also can be covered in the curved needle guide section 42.

Essentially the carriage 20 comprises two upwardly projecting lateral parts 22 connected in a bail-like manner by a yoke 21. In the example embodiment, each lateral part 22 is mounted to one of the aforementioned gear racks 16. When the drive pinion 15 is rotated, the carriage 20 accordingly is displaced by the gear racks 16 in the longitudinal direction, that is, parallel to the heddle frames 19. This kind of drive using gear racks is shown both in FIG. 3 and in FIG. 5. FIG. 3 furthermore shows on the left-hand side how a gear rack 16 is being displaced to the left.

Figure 6A:
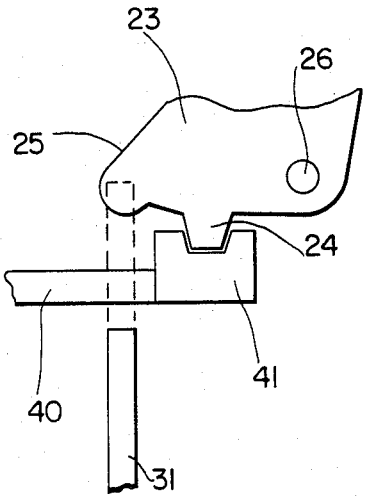
FIG. 6*a* is a detail of the needle coupling of FIG. 4.
Figure 6B:
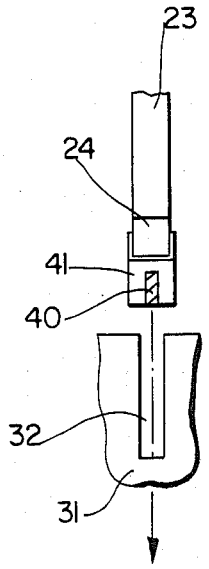
FIGS. 6*b* and 6*c* are two cross-sections through FIG. 6*a* in different coupling positions.
Figure 6C:
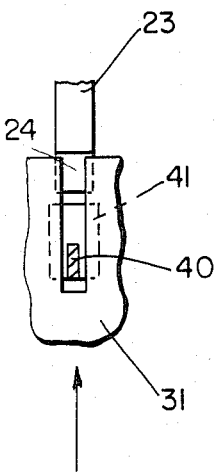

A tilting shaft 26 is mounted in the lateral parts 22 and spans the needle bed 18. A row of coupling pawls 23 is rotatably supported on this tilting shaft 26. One individual coupling pawl is provided for each of the individual draw-in needles 1 to 6 as represented in FIG. 5. The coupling pawls 23 can assume two defined tilting positions on the tilting shaft 26 and are kept in one or the other tilting position by a spring latch 27. One of the tilting positions is shown in FIG. 4 by solid lines, the other by dash-dot lines. In the first position, one coupling pawl 23 engages by an engagement beak 24 a clearance in a needle shoe 41 provided at the end of a respective draw-in needle 40. In this manner the needle will be coupled to the carriage 20. This coupling is shown more clearly in FIG. 6*a* than by FIG. 4. Each individual needle 1 to 6 of the draw-in needles 40 as represented in FIG. 5 is provided with it own individual coupling including a coupling pawl 23. When the carriage 20 is displaced, all the coupling pawls 23 mounted on the tilting shaft 26 are carried along, but only those needles will also be moved along which are coupled by the engagement beak 24. The remaining needles are disengaged from the respective beak 24 and therefore remain in their rest position in the needle bed 18.

A control drive 28, aforementioned, is provided to implement the engagement and disengagement of the draw-in needles 40. In a preferred embodiment of this control drive, it includes, as shown in FIG. 4, essentially a cam shaft 29 with switching cogs 1′, 2′, 3′, 4′, 5′, 6′ angularly offset from each other. An individual switching cog 1′ and 6′ is provided for each needle 1 to 6 with its associated individual coupling. The control mechanism 28 is not described in further detail since it is of conventional construction and may be, for instance electronically programmed. The cam shaft 29 is rotated about its axis in a stepwise manner, whereby each step corresponds to the particular angular spacings of the switching cogs. The individual switching cogs in this process tilt over the particular coupling pawls 23 associated therewith, namely about the tilting shaft 26, from the rest position shown in dash-dot lines into the operational position shown in solid lines, as indicated in FIG.

4, where the engagement beak 24 reaches into a clearance of the respective needle shoe 41. Depending upon the number of rotational steps performed by the cam shaft 29, the corresponding number of individual couplings 23 is actuated consecutively, and as regards the example illustrated herein, always in ascending series 1, 2, 3, . . . , as already mentioned. Other coupling structures are also possible and furthermore the switching sequence also may be selected in a different manner if required.

After the reciprocation of the carriage 20 has caused a draw-in procedure, all couplings are automatically released, when the carriage 20 is returned together with the needles it entrains, in their end position. A stationary return system is provided to that end at the needle bed 18. Various embodiments are also conceivable for this purpose. It is assumed in FIG. 4 that the return system is a switching magnet 30 which by means of the switching studs 31 shown in FIG. *6a* effects the return of the respective coupling pawl 23. FIGS. *6a, 6b,* and *6c* more clearly show the engaging and disengaging operation. FIG. *6a* is on a somewhat larger scale than FIG. 4 and shows in a side view the engagement by the engaging beak 24 of the needle shoe 41 provided at the rear end of a needle 40 whereby the needle 40 is coupled to the carriage. The coupled position or "in" position is also shown in FIG. *6b* in a view in the needle length direction. FIG. *6c* shows the uncoupled or disengaged position. A switching stud 31 is shown below the needle 40 in the retracted, inoperative position of the stud 31 in FIGS. *6a* and *6b*. This switching stud 31 is provided, for example, with a cut-out 32 enclosing the needle 40 when, upon actuation of the switching magnet 30 (not shown here), the switching stud 31 is displaced as shown in FIG. *6c* in the direction of the arrow. The upper edge of the switching stud 31 comes to rest against the switching cam 25 of the coupling pawl 23 and tilts the same about the tilting shaft 26 into the other end position. Thereby, the engaging beak 24 and the needle shoe 41 are disengaged and accordingly the respective needle is decoupled again. The displacement of the switching stud 31 toward the switching cam 25 is shown in dashed lines in FIG. *6a*. The retracted single coupling presently is available again for a new selection of needles. Depending upon the circumstances, the return system can be so constructed that it is provided in common for all of the single couplings. However, other constructions also are conceivable wherein an individual return device is associated with each needle, i.e., each single coupling.

Lastly, the principle of coupling the draw-in needles with a reciprocating carriage also can be applied independently of the example embodiments described, for instance for an arrangement with draw-in needles which are guided in a completely rectilinear manner, without being deflected from their directions.

It will be appreciated by those skilled in the art that many modifications may be made within the scope of the present invention without departing from the spirit thereof, and the invention includes all such modifications.

We claim:

1. In an apparatus for drawing warp threads out of a warp thread curtain in a predetermined position into readied heddles and drop wires with the aid of a plurality of draw-in needles arranged in parallel to one another and movable back and forth relative to said curtain of warp threads for passing through eyes of said heddles and drop wires, the improvement comprising movable carriage means (20), fixed guide means for guiding movements of said carriage means, said fixed guide means comprising needle bed means arranged for cooperation with said carriage means, guide grooves in said needle bed means for holding said plurality of draw-in needles in said guide grooves in a movable, guided manner for moving and guiding said draw-in needles (40) back and forth relative to said warp threads, drive means (10) operatively connected to said carriage means (20) for displacing said carriage back and forth in a reciprocating manner, coupling means (23) for selectively coupling any one of said draw-in needles to said carriage means for guided movement with said carriage means along said guide means, and control means (28) operatively arranged for cooperation with said coupling means for controlling a selective coupling operation.

2. The apparatus of claim 1, wherein said drive means (10) comprise at least one toothed rack means (16) mounted to said carriage means (20), and drive pinion means (15) operatively arranged for cooperation with said rack means for alternating the direction of rotation and thus the direction of movement of said carriage means.

3. The apparatus of claim 1, wherein said coupling means comprise for each draw-in needle a pawl, mounting means for said pawl for tilting said pawl into two defined pawl positions, each pawl including an engagement beak for engaging a recess in the respective draw-in needle for coupling the respective needle to said carriage means in one of said defined pawl positions and for decoupling the respective needle from said carriage means in the other of said two pawl positions.

4. The apparatus of claim 3, wherein said control means for controlling said coupling means comprise a switching cog for each of said pawls for switching the respective pawl into a coupling position.

5. The apparatus of claim 3, further comprising pawl return means operatively arranged for moving said pawls into a decoupling position.

6. The apparatus of claim 5, wherein said pawl return means comprise a switching stud means for each pawl, and electromagnetic means for operating said switching stud means.

7. The apparatus of claim 1, wherein said coupling means comprise for each draw-in needle a pawl, means for mounting said pawls on said carriage means, said mounting means including a bail (21, 22) briding said carriage means for straddling said draw-in needles, and a shaft (26) held in said bail for tiltably holding said pawls.

8. The apparatus of claim 1, wherein said needle bed means is provided with a straight section and a curved section, said straight section having a length corresponding approximately to the extent of reciprocation of said carriage means.

9. The apparatus of claim 8, further comprising heddle frames (19) extending in a given direction, said carriage means extending in parallel to said given direction of said heddle frames, and wherein said curved section of said needle bed means forms a curve of about 90° toward said heddle frames and thus toward said warp thread curtain.

* * * * *